US005095793A

United States Patent [19]

Button

[11] Patent Number: 5,095,793

[45] Date of Patent: Mar. 17, 1992

[54] CUTTER DRIVE VIBRATION DAMPENING SYSTEM

[75] Inventor: Donald C. Button, Cheshire, Conn.

[73] Assignee: Gerber Garment Technology, Inc., West Tolland, Conn.

[21] Appl. No.: 492,672

[22] Filed: Mar. 13, 1990

[51] Int. Cl.[5] ..... B26D 1/10

[52] U.S. Cl. ..... 83/628; 83/748; 83/632; 74/603; 74/604

[58] Field of Search ..... 74/25, 38, 40, 589, 74/590, 591, 603, 604; 83/628, 632, 748

[56] References Cited

U.S. PATENT DOCUMENTS 4,048,891 9/1977 Pearl ..... 83/628 X
4,924,727 5/1990 Pearl et al. ..... 83/748 X

*Primary Examiner*—Timothy V. Eley
*Attorney, Agent, or Firm*—McCormick, Paulding & Huber

[57] ABSTRACT

A vibrational dampening system in a cutter head having an elongate knife reciprocated to cut a ply or a stack of plies of sheet material comprises a drive pulley having an eccentrically mounted pin on which is journalled a linkage connecting the drive pulley to the knife, and two driven pulleys located on either side of the drive pulley synchronously interconnected with the drive pulley by a belt having spaced apart teeth formed on each side. The drive pulley and each of the two laterally disposed driven pulleys has a counterweight which rotates 180 degrees out of phase with the rotation of the eccentric pin in order to cancel the vertical forces generated by the reciprocating knife and its associated connecting linkage. The two laterally disposed driven pulleys rotate in an opposite direction relative to the rotational direction of the drive pulley in order to cancel any side-to-side forces generated when the counterweights move between vertically oriented positions.

19 Claims, 5 Drawing Sheets

CUTTER DRIVE VIBRATION DAMPENING SYSTEM

CROSS REFERENCE TO RELATED APPLICATION

The present invention relates to U.S. Pat. No. 4,924,727 filed on July 17, 1989 entitled BALANCED RECIPROCATING DRIVE MECHANISM and issued to Pearl et al. on May 15, 1990, which patent being commonly assigned with the assignee of the present invention.

BACKGROUND OF THE INVENTION

The present invention resides in a cutter drive in which rotary motion derived from a rotary drive source is translated into reciprocating linear motion driving an elongate knife through a given stroke to cut patterns in a ply or a stack of plies of sheet material, and more particularly relates to a vibration dampening system employed in the cutter drive in which means are provided for dynamically balancing the full mass of the reciprocating knife and any associated connecting linkage without creating uncompensated lateral forces.

In known machines for cutting sheet material spread on a supporting surface, an elongate knife is eccentrically connected to a rotating flywheel to effect reciprocation of the knife when the flywheel is rotated. An example of one such type of eccentric drive arrangement for reciprocating a knife is disclosed in U.S. Pat. No. 4,048,891 issued on Sept. 20, 1977 to Pearl which, patent being commonly assigned with the assignee of the present invention and being hereby incorporated by reference. In this patent, a swivel device linking the flywheel with the knife is employed to effect controlled rotation of the knife about its axis of reciprocation in order that the leading edge be made to follow given a path along which the material is to be cut. To do this however, it is necessary that the swivel linkage as well as the knife together be reciprocated by the eccentric drive. Although this arrangement has proven to be a very effective means for guiding the knife along a designated path, it has been found that the reciprocated mass constituted by the knife and the swivel device, or even the knife alone, generates undersirable vibrations when the flywheel rotates at a high speed, for example at about 5200 revolutions per minute. These vibrations may detrimentally affect the accuracy of a control resolver positioned adjacent the knife generating feedback signals to a controller which may in turn alter the cutting path of the blade as necessary to compensate for any detected deviation from a predetermined cutting parameter. In addition, these vibrations wear and loosen otherwise rigidly connected parts on the cutting machine thus requiring additional maintenance which otherwise would not be necessary. Also, when the flywheel is rotated at high speeds, the vibrations caused by the reciprocating mass generates high noise levels in the surrounding work environment.

Hitherto, attempts have been made to reduce the vibrations caused by the reciprocating knife assembly by offsetting the reciprocated mass by placing a counterweight on the flywheel located diametrically oppositely of the connecting point between the knife linkage and the pulley. While such a measure has proven to be partially effective in compensating for the reciprocating mass, its effectiveness to fully compensate for the reciprocated load is nevertheless limited by the lateral forces introduced into the system when the counterweight moves from top dead center to bottom dead center and vice versa in its rotation. Due to these lateral or side-to-side dynamic forces, the offsetting mass of the counterweight could never be more than a percentage, usually on the order of 50 percent, of the total reciprocated mass constituted by the reciprocating knife and its associated eccentric mounting connection.

In accordance with the invention, a cutter drive vibrational dampening system is provided wherein the substantially entire mass of the reciprocating knife and its associated eccentric connection is compensated for without introducing additional lateral forces to the cutter head and system supporting it.

A further object of the invention is to provide a dynamically balanced drive system which reduces the operating noise level of a cutter head as well as reducing the amount of wear to the head and its associated component parts.

Yet, a further object of the present invention is to provide a dynamically balanced drive system in which both vertical and horizontal forces are balanced at various rotational velocities.

Other objects and features of the invention will become apparent from the disclosure and the appended claims.

SUMMARY OF THE INVENTION

The invention resides in an dynamically balanced drive system used in a cutter head of the type wherein rotational movement from a rotary drive source is translated into linear reciprocating movement driving a knife through a given stroke. The system includes a support and a drive pulley rotatably mounted to the support and being connected to the rotary drive source for rotation about a first axis. The drive pulley has a reciprocating means which includes a mounting pin for eccentrically connecting the knife to it to create the reciprocating knife movement and has a dampening means associated with it having a mass center located diametrically oppositely of the connecting pin. Associated with the drive pulley and located on one side of it is a first driven pulley and on its other side a second driven pulley each of which pulleys being freely rotatably mounted on the support for rotation respectively about second and third central axes. The drive pulley and each of the first and second driven pulleys are synchronously drivingly connected with one another by rotational coupling means such that the drive pulley is rotated in a first direction and each of said first and second driven pulleys is rotated in an opposite direction.

The first and second driven pulleys also have dampening means which together with the dampening means associated with the drive pulley act to counterbalance substantially the total reciprocated mass constituted by the knife and its associated connecting structure. The relative masses of the dampening means is such that this counterbalancing is achieved without introducing uncompensated lateral forces.

A further aspect of the present invention is the positioning of each of the first, second and third central axes in a common plane in order to eliminate any force couple which may develop if the axes were otherwise not so oriented.

DETAILED DESCRIPTION OF THE PREFERRED EMBODIMENT

Figure 1:
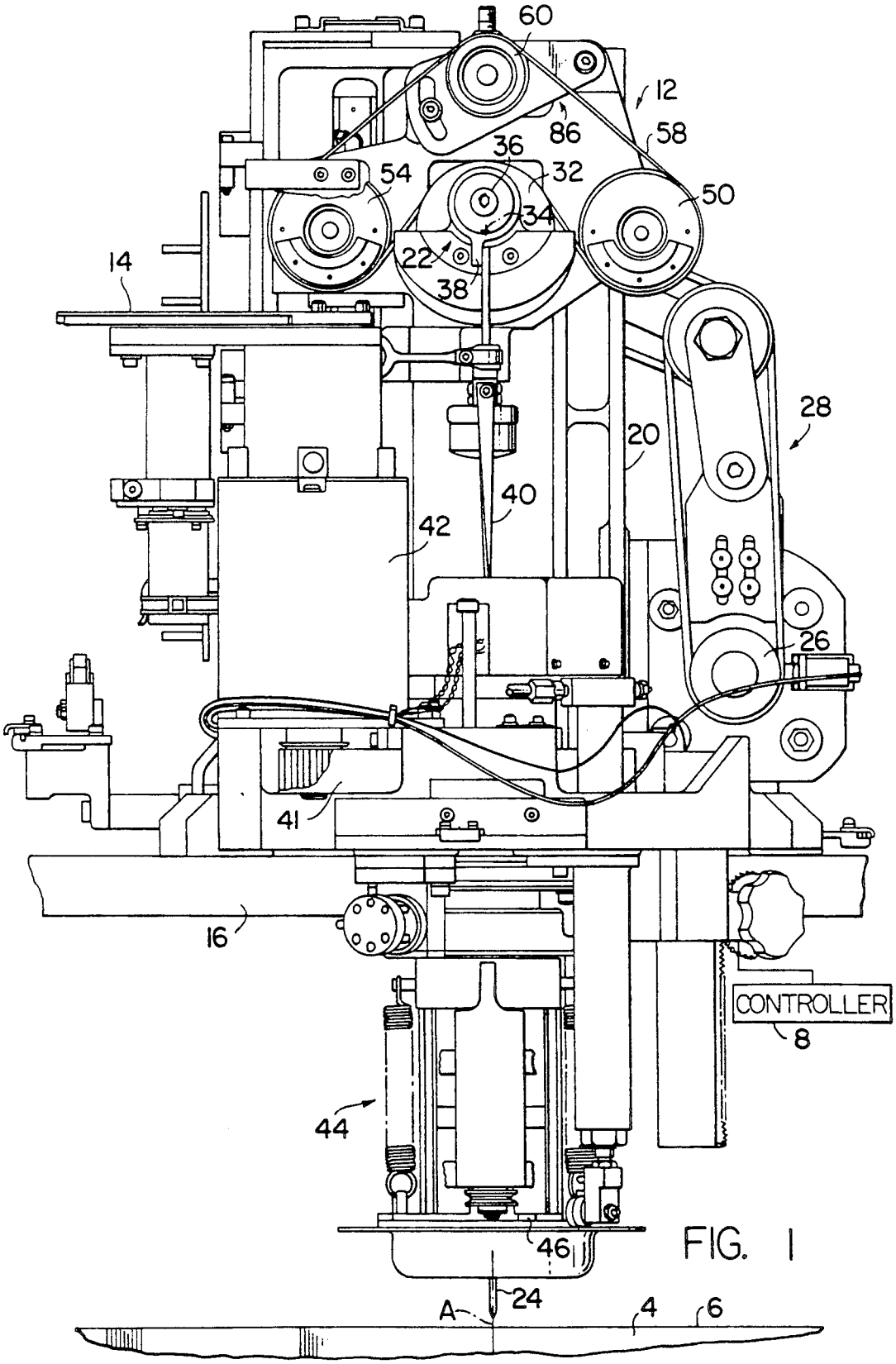
FIG. 1 is a front elevation view of a cutter head employing the vibration dampening system of the present invention.
Figure 2:
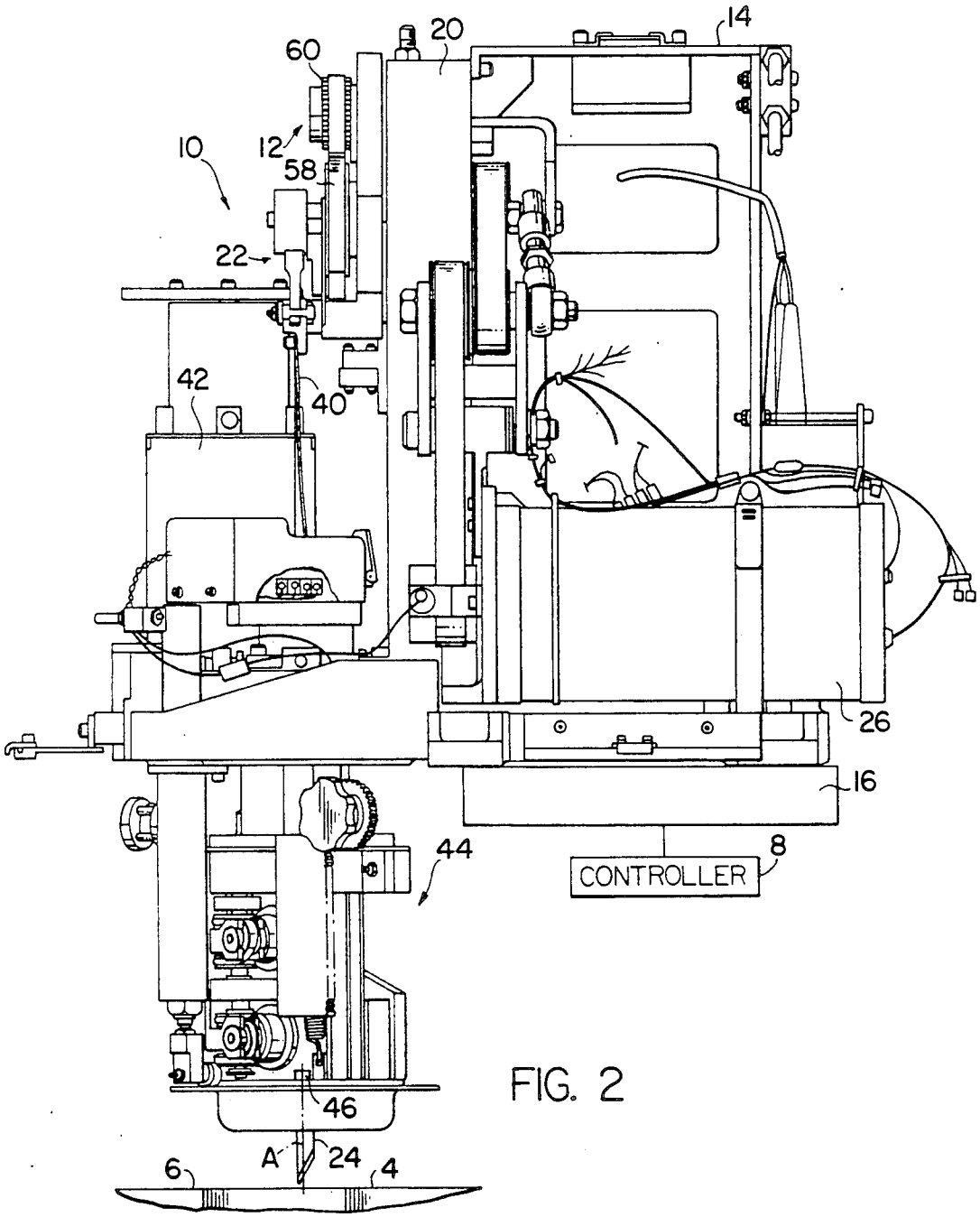
FIG. 2 is a side elevation view of the cutter head of FIG. 1.

Referring now to the drawings, and in particular to FIGS. 1 and 2, a cutting machine indicated generally by the reference numeral 10 employing a cutter drive vibrational dampening system embodying the present invention and designated generally by the reference numeral 12 is shown. The cutting machine 10 comprises a cutter head 14 having a reciprocating knife 24, a permeable bed 4 defining a support surface 6, above which the cutter head is moved by the combined movements of an X carriage (not shown) and a Y carriage 16 (shown schematically) each in turn moved by suitable drive means responding to instructions from a controller 8. Each of the X and the Y carriage drive means receives signals from the controller 8 such that the cutter head 14 follows a designated path over the surface 6 to cut pattern pieces from various types of sheet material, such as woven and non-woven fabrics and plastics.

The cutter head 14 includes a vertically movable knife frame 20 carrying a reciprocating means 22 connected with the elongated knife 24 for reciprocating it through a given stroke. The reciprocating means 22 is comprised of a drive pulley 32 rotatable about a first central axis 34 and has an outwardly extending mounting pin 36 positioned eccentrically on it relative to the central axis 34. The reciprocating means 22 is driven by a rotary drive source 26 through a movable belt linkage 28 engaged at one end with the drive source 26 and at its other end with a rotary input pulley 30 rotatably coupled with the drive pulley 32. Journalled about the mounting pin 36 is a knife connector 38 which allows the upper end of a reciprocating linkage 40 connected to the knife 24 to rotate about the central axis 34 thereby creating the reciprocating cutting motion in the knife. The linkage 40 is of the type disclosed in the aforementioned U.S. Pat. No. 4,048,891 which is rigidly attached at its upper end to the connector 38 and at its lower end to the knife 24 and has interposed between these points a swivel device (not shown) allowing the knife to rotate relative to the linkage. The swivel device is in turn received within a guide tube supported for rotation about a theta axis A within a sprocket wheel 41 controllably rotated by a theta drive motor 42. The theta motor 42 receives commands from the controller 8 to rotate the sprocket wheel 41 and thereby change the angular orientation of the knife 24. The lower end of the knife is supported against bending and deflection by a guide 44 depending from the cutter head 14 and extending below the Y carriage. A conventional sensing device indicated schematically at 46 is fixed to the guide and provides feedback signals in a closed loop automatic control system from which the controller 8 adjusts the orientation of the knife 24 by initiating commands to the theta drive motor 42 to maintain a predetermined line of cut.

In accordance with the invention, the cutter drive vibration dampening system 12 employs means by which the knife 24 and its associated connecting linkage are reciprocated in a balanced state when the drive pulley 32 is rotated at an operational angular velocity. To this end, the drive system 12 includes the drive pulley 32, a first driven pulley 50 and a second driven pulley 54, a drive belt 58, an adjustable idler pulley 60 and dampening means associated with each of the first and second driven pulleys and with the drive pulley 32. The first driven pulley 50 is freely rotatably mounted to the knife frame 20 on one side of the drive pulley 32 for rotation around its central axis 52 while the second driven pulley 54 is likewise freely rotatably mounted on the knife frame 20 on the opposite side of the drive pulley 32 for rotation around its central axis 56. This arrangement facilitates balancing of forces and couples within the system 12 as will hereinafter be discussed in greater detail later.

Figure 5:
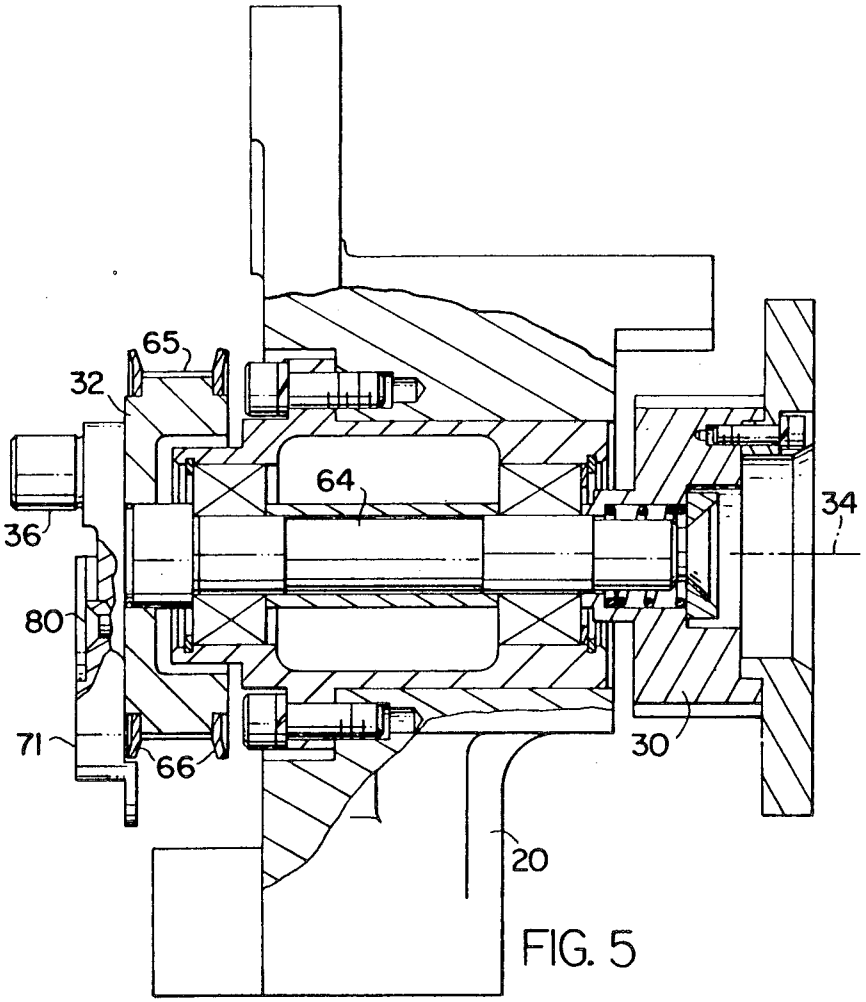
FIG. 5 is a partially fragmentary side elevational view of the drive pulley and its related supporting structure.

Referring now to FIGS. 3–5 and 8 and the manner in which the drive belt 58 drivingly couples each of the first and second driven pulleys 50,54 with the drive pulley 32, it will be seen that the drive belt 58 is particularly well adapted for positively engaging with the first and the second driven pulleys 50,54 and with the drive pulley 32 to drive them in synchronous rotation with one another. As shown in FIG. 5, rotary driving motion delivered to the input pulley 30 from the rotary drive source 26 via the movable belt linkage 28 is in turn transferred through a shaft 64 to the drive pulley 32 fixed to it. This motion is delivered to each of the first and second driven pulleys 50,54 from the drive pulley 32 by the belt 58 engaging with the involved pulley in a non-slip manner. To effect this, each of the first and second driven pulleys 50,54, the drive pulley 32, and the idler pulley 60 has a series of circumferentially extending equally spaced apart teeth 65, 65 disposed thereabout which define its outer diameter. These teeth are sized and configured for coengagement with correspondingly sized and shaped teeth formed on the belt 58 as is apparent from FIG. 8. An example of effective spacing between teeth would be to form the teeth with 0.200 inch pitch. To maintain the drive belt 58 on the drive pulley 32 and consequently on the remaining driven pulleys when the drive pulley 32 is rapidly rotated, flanges 66,66 are provided on the drive pulley 32 and extend annularly outwardly about it for this purpose.

Figure 3:
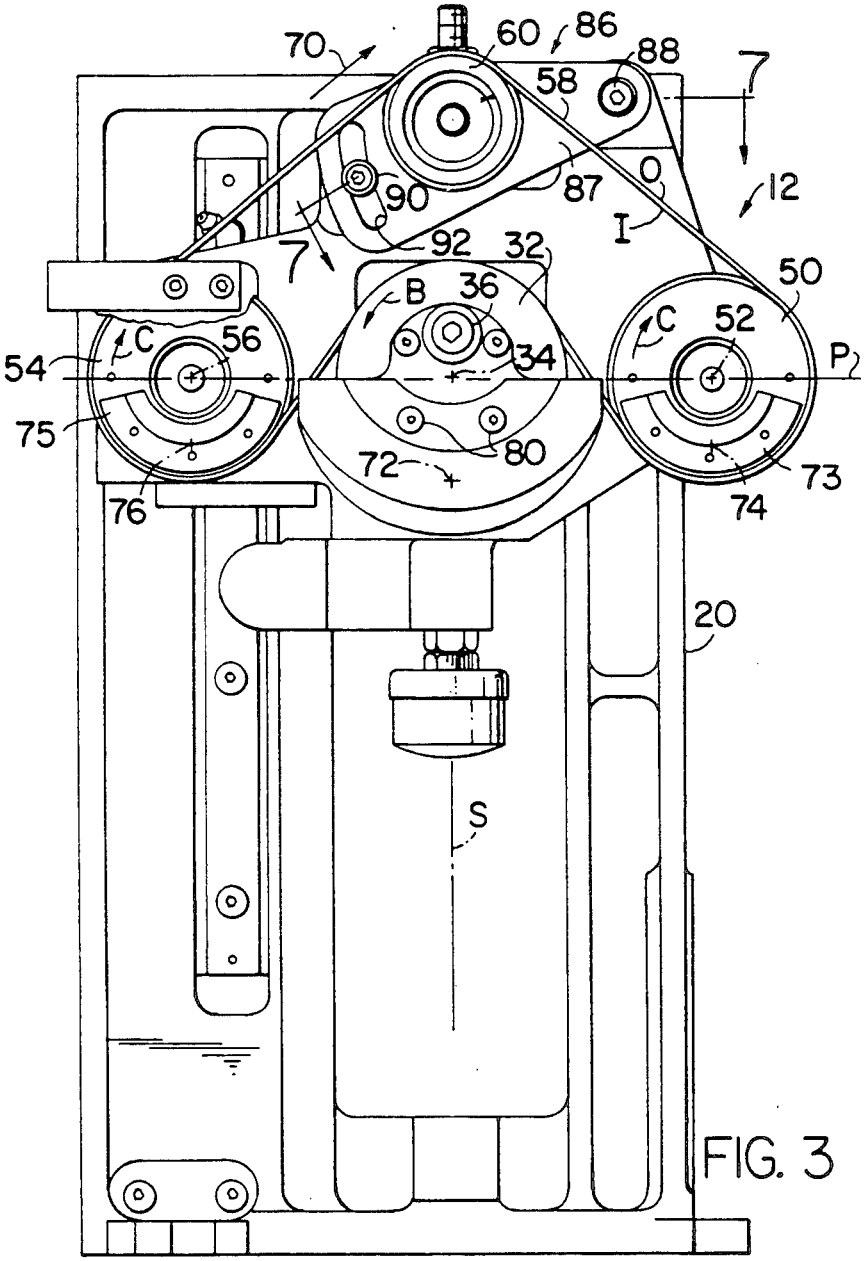
FIG. 3 is an enlarged scale front elevation view of the knife frame shown separately from the cutter head on which frame is mounted the cutter drive vibration dampening system.

As illustrated by the directional arrows in FIG. 3, the path traveled by the drive belt 58 counter-rotates each of the first and second driven pulleys 50,54 relative to the rotational direction of the drive pulley 32. It should be seen from FIGS. 3 and 8 that the belt 58 is a double sided synchronous belt defined by an inner side I and an outer side O and that the drive pulley 32 rotates in the indicated B direction to move the drive belt 58 in the indicated direction 70 by engaging with the teeth disposed on the outer side O. The first and second driven pulleys 50,54 are engaged by the teeth arranged along the inner side I of the drive belt 58 and are consequently rotated in the indicated opposite C clockwise rotational direction when the drive pulley 32 is driven in the indicated B counterclockwise rotational direction.

In order to balance the vertical dynamic forces created by the knife and its associated reciprocating connecting linkage along stroke axis S, a dampening means is provided on the drive pulley 32 and on each of the first and second driven pulleys 50,54 to offset these forces. The dampening means includes a first counterweight 71 having a mass center at 72 fixedly secured to the drive pulley 32 by suitable connecting means such as screws 80,80. Similarly, a second counterweight 73 having a mass center at 74 is secured to the first driven pulley 50 while a third counterweight 75 having its mass center at 76 is secured to the third driven pulley 54. The counterweights 73 and 75 are secured to the pulleys by screws 82 threadedly engaging within correspondingly threaded openings in each counterweight. To enhance the balancing effect of the counterweights 71, 73 and 75, the drive pulley 32 and each of the first and second driven pulleys 50,54 may be formed from a light metal, such as aluminum, while each counterweight may be formed from a heavier metal, such as steel.

As previously discussed, the belt 58 drives each of the first and second driven pulleys 50,54 with the drive pulley 32 in synchronous engagement therewith. This is important in that when in the horizontal plane P, the synchronous rotation of these pulleys maintains the mass center of each associated counterweight of the pulleys 73 and 75 180 degrees out of phase with the simultaneously rotating counterweight 71 of the drive pulley 32. As an example of this, in FIG. 3 the mounting pin 36 is located at a position corresponding to the upper limit of the knife stroke or at top dead center of the pin 36 revolution. At this point in the rotation of the drive pulley 32, it should be seen that the mass center 72 of the counter-weight 71 is diametrically opposite the position of the mounting pin 36 or at its bottom dead center position. Along with the mass center 72, the respective mass centers 74 and 76 of the counterweights 73 and 75, are likewise positioned at bottom dead center positions. Since the combined mass of the counterweights 71,73 and 75 is equal to that of the knife 24 and its associated linkage, vertical forces caused by the reciprocated mass will thus be balanced along the stoke axis S.

To achieve balancing of horizontal forces created within the system 12 when the counterweights rotate through the horizontally disposed plane P, the relative masses of the counterweights 71, 73, and 75 are selected such that when rotated, the horizontal forces created by the counterweights cancel. For this purpose, the mass of each of the counterweights 73 and 75 is selected to be substantially equal to one-half the mass of the counterweight 71. Since the first and the second driven pulleys 50, 54 have identical diameters equal to the diameter of the drive pulley 32 and have an equal number of teeth disposed thereabout, all three pulleys rotate in unison with one another at the same angular speed. As a result, once the counterweight 72 begins to rotate in the indicated B rotational direction and moves through the horizontally disposed plane P from, for example, its bottom dead center position as shown in FIG. 3, the counterweights 73, 75 simultaneously will move in the opposite direction with the same angular displacement thereby cancelling any force directed laterally of the stroke axis S by the counterweight 72.

In summary, it should be seen that the first and the second driven pulleys 50, 54 rotate synchronously with the drive pulley 32 to balance both vertical and horizontal forces in the system. To effect vertical force balancing, the mass centers of each of the counterweights 71, 73 and 75 together rotate 180 degrees out of phase with the angular position of the connecting pin 36 through which pin the knife and its connecting linkage is attached to the drive pulley 32. Since the total mass of each of the counterweights 71, 73 and 75 is substantially equal to that of the knife and its associated connecting linkage, the vertical forces caused by the reciprocating mass are balanced. To balance the horizontally directed forces, the first and second driven pulleys 50, 54 move synchronously with the drive pulley 32 but in an opposite direction and the counterweights associated with the first and second pulleys are each one-half the total mass of the counterweight 71 associated with the drive pulley 32. Thus, lateral forces created by the rotation of these counterweights are also balanced in the system.

Figure 7:
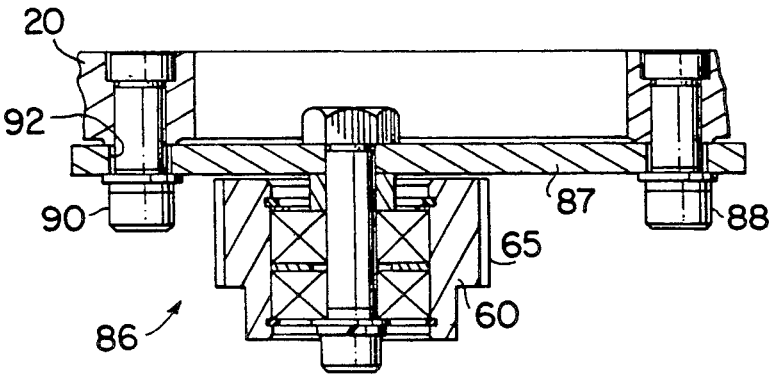
FIG. 7 is a sectional view taken along line 7—7 in FIG. 3 through the knife frame illustrating the idler pulley adjustment mechanism.
Figure 4:
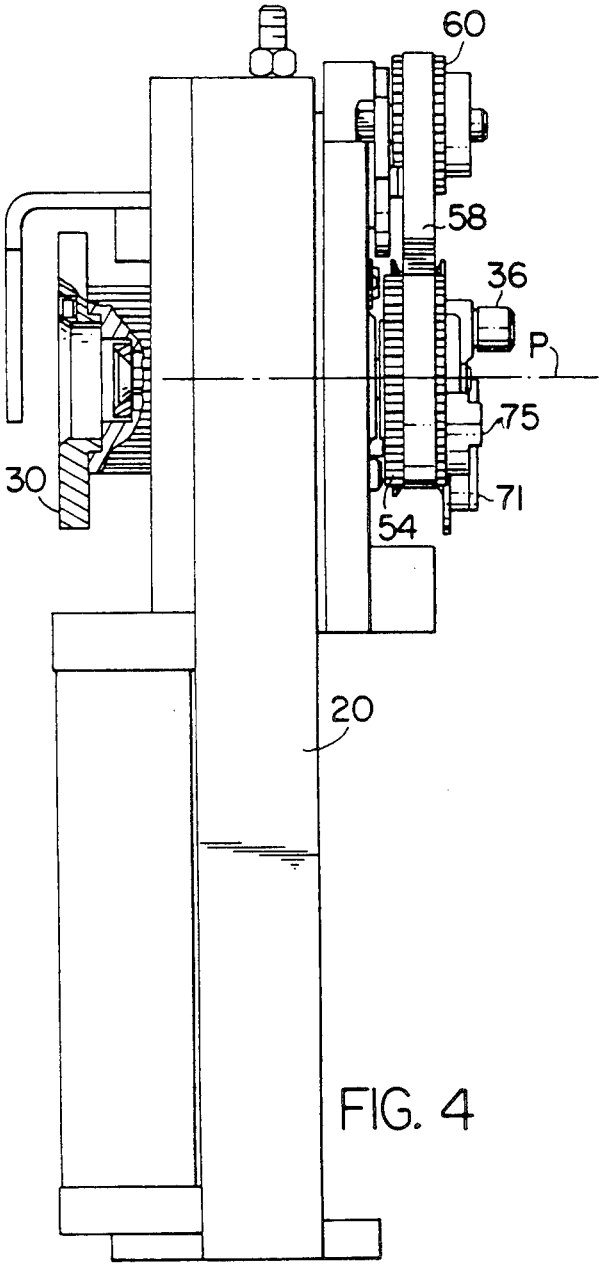
FIG. 4 is a partially fragmentary side elevation view looking at the knife frame of FIG. 3 from the left.
Figure 6:
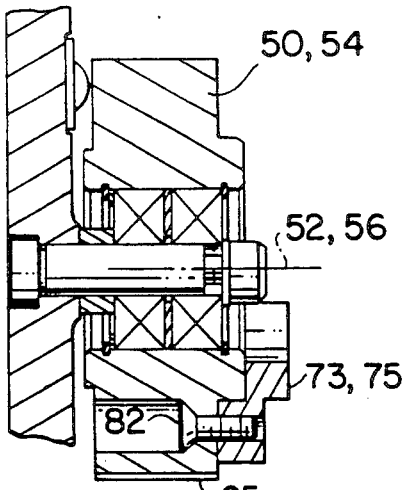
FIG. 6 is a vertical sectional view through one of the two counterbalancing driven pulleys.
Figure 8:
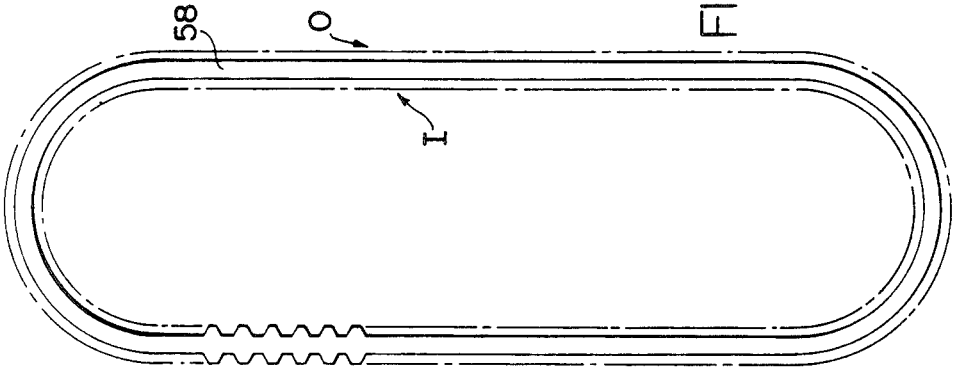
FIG. 8 shows the drive belt employed by the present invention.

It is another feature of the present invention that the rotational axes 34, 52 and 56 are each positioned in a common horizontal plane P. This avoids the creation of a horizontal force couple which otherwise will exist if these axes were not so commonly oriented. The idler pulley 60 makes this arrangement possible by diverting the section of the belt 58 which runs back across the drive pulley 32 away from it thereby avoiding interference with the belt section traveling in the opposite direction. As is shown in FIG. 3 and in greater detail in FIG. 7, the idler pulley 60 has a tension take-up means 86 associated with it. The take-up means 86 includes a mounting plate 87 upon which the pulley 60 is freely rotatably mounted and is adjustably connected with the knife frame 20 by the pivot bolt 88 passing through an opening in the plate 87 and an adjustment bolt 90 communicating through an adjustment slot 92 formed in the plate 87 cooperating with the pivot bolt 88.

From the foregoing, a cutter drive vibrational dampening system has been described in the preferred embodiment of the invention. However, it should be understood that numerous modifications and substitutions may be made without departing from the spirit of the invention. For example, in a slight modification to the illustrated embodiment, the tension take-up means 86 associated with the pulley 60 may take the form of a spring biasing arm which applies a constant tension force to the belt 58 as it is rotated. Furthermore, in the illustrated example of FIG. 2 it is disclosed that the drive pulley 32 is rotated in the illustrated counterclockwise direction B. However, these illustrative directional examples do not preclude the cutter drive system from operating equally effectively if the desired rotational direction of the drive pulley 32 were to be the opposite clockwise direction. Accordingly, the present invention has been described by way of illustration rather than limitation.

I claim:

1. In a cutter head of the type having a reciprocating knife and associated structure drivingly interconnecting the knife with the cutter head, a vibration dampening system for balancing the dynamic forces created by the reciprocation of said knife and said associated connecting structure, said vibration dampening system comprising:

a support;

a drive pulley rotatably mounted on said support for rotation about a first central axis, said drive pulley having means for eccentrically connecting to it for rotation about said first central axis a reciprocating mass in the form of a knife and associated structure drivingly interconnecting said knife to said cutter head;

a first driven pulley freely rotatably mounted on said support on one side of said drive pulley for rotation about a second central axis;

a second driven pulley freely rotatably mounted on said support on the other side of said drive pulley for rotation about a third central axis;

a rotary drive source connected with said drive pulley for rotating it in a first rotational direction;

coupling means for drivingly connecting each of said first and said second driven pulleys with said drive pulley such that each of said first and said second driven pulleys rotates with said drive pulley but in a second opposite direction; and dampening means associated with said drive pulley and with each of said first and said second driven pulleys for substantially counterbalancing the full reciprocating mass constituted by said knife and said associated connecting structure without introducing unbalanced lateral forces into the system.

2. The combination as defined in claim 1 further characterized in that said coupling means includes a drive belt having an inner side and an opposite outer side;

said inner side of said drive belt drivingly engaging with each of said first and second driven pulleys; and wherein said drive belt outer side engages with said drive pulley.

3. The combination as set forth in claim 2 further characterized in that said dampening means includes a first counterweight fixed to said drive pulley, a second counterweight fixed to said first driven pulley and a third counterweight fixed to said second driven pulley; and wherein the combined mass of each of said first, second and third counterweights is equal to said reciprocating mass.

4. The combination as set forth in claim 3 further characterized in that said rotational coupling means includes an adjustable idler pulley positioned along the path of travel of said drive belt between said second driven pulley and said first driven pulley such that the length of said drive belt passing therebetween is spaced from said drive pulley.

5. The combination as set forth in claim 4 further characterized in the said first, second and third central axes are each located in a common horizontal plane with one another.

6. The combination as set forth in claim 4 further characterized in that formed along each of said inner and outer sides of said drive belt are a series of equally spaced apart drive teeth; and wherein each of said first and said second driven pulleys, said drive pulley and said idler pulley has equally spaced apart circumferentially oriented teeth sized configured respectively for coengagement with correspondingly sized and configured ones of said teeth oriented on said first and second sides of said drive belt.

7. The combination as set forth in claim 3 further characterized in that formed along each of said inner and outer sides of said drive belt is a series of equally spaced apart drive teeth;

each of said first and said second driven pulleys, and said drive pulley has equally spaced apart circumferentially oriented teeth sized and configured respectively for coengagement with correspondingly sized and configured ones of said teeth oriented on said first and second sides of said drive belt;

each of said first and said second driven pulleys and said drive pulley being equal in diameter relative to one another; and wherein said drive belt engages with said teeth on each of said pulleys to rotate said drive pulley and each of said first and said second driven pulleys at the same angular speed.

8. The combination as set forth in claim 7 further characterized in that said first counterweight has a mass substantially one-half of said reciprocated mass and said second and said third counterweights each has a mass substantially equal to one-half of the mass of said first counterweight.

9. The combination as set forth in claim 8 further characterized in that said means for eccentrically connecting said reciprocating mass to said drive pulley includes a connecting pin formed on said drive pulley eccentrically oriented thereon relative to said first central axis; and said associated connecting structure comprises a knife linkage having means for journalling it about said connecting pin to create reciprocating motion in said knife when said drive pulley is rotated; and wherein the mass center of said first counterweight is positioned diametrically oppositely of said connecting pin such that the first counterweight mass center and the connecting pin are oriented 180 degrees apart.

10. The combination as set forth in claim 9 further characterized in that the mass centers of each of said second and third counterweights respectively associated with said first and said second driven pulleys correspond in angular orientation to the mass center of said first counterweight such that when said connecting pin is rotated to its top dead center position, the mass centers of each of said first, said second and said third counterweights are at the bottom dead center positions of their respective revolutions; and conversely positioning of the connecting pin at a bottom dead center position of its revolution corresponds to mass centers of said first, said second and said third counterweights being at top dead center positions of their respective revolutions.

11. The combination as set forth in claim 10 further characterized in that each of said first and said second driven pulleys and said drive pulley is formed from aluminum; and wherein each of said first, said second and said third counterweight is formed from steel.

12. The combination as set forth in claim 11 further characterized in that said drive pulley has a pair of annular flanges extending outwardly beyond its circumferentially oriented teeth between which flanges the drive belt is received.

13. The combination as set forth in claim 3 further characterized in that said first counterweight has a mass one-half of said reciprocated mass and said second and said third counterweights each has a mass substantially equal to one-half of the mass of said first counterweight; and wherein the net effect of the rotation of each of said first, second, and third counterweights occurs along the line of reciprocation of said reciprocating mass.

14. A vibrational dampening system for use in a cutter head in which an elongate knife and associated linkage drivingly interconnecting the knife with the cutter head are reciprocated, said vibrational dampening system comprising:

a support;

a drive pulley rotatable about a first central axis and mounted to said support, said drive pulley having a connecting pin extending laterally outwardly of said drive pulley;

said connecting pin being disposed eccentrically relative to said first central axis and being connected with a reciprocating mass constituted by a knife and associated linkage drivingly interconnecting the knife with the cutter head;

a first counterweight disposed diametrically oppositely of said connecting pin on said drive pulley such that the mass center of said first counterweight is oriented 180 degrees from said connecting pin;

a first driven pulley freely rotatably mounted to said support on one side of said drive pulley for rotation about a second central axis, said first driven pulley having a second counterweight disposed thereon;

a second driven pulley freely rotatably mounted on said support on the other side of said drive pulley for rotation about a third central axis, said second drive pulley having a third counterweight disposed thereon for rotation about said third central axis;

said drive pulley and each of said first and said second driven pulleys each having equal diameters defined by a series of evenly spaced teeth circumferentially disposed around each of said first and said second driven pulleys and said drive pulley;

a drive belt having on two sides a series of teeth sized and configured for coengagement with said teeth disposed on each of said first and said second driven pulleys and said drive pulley;

said drive belt engaging with said drive pulley and each of said first and said second driven pulleys to rotate said first and second driven pulleys in an opposite direction relative to that of said drive pulley; and wherein said first, second and third counterweights being arranged on said support and having selected masses which cancel the dynamic vertical forces created by the reciprocating motion of said knife and said associated connecting linkage without introducing unbalanced lateral forces.

15. A vibrational dampening system as defined in claim 14 further characterized in that said drive belt has an inner and an outer side each defined by a series of spaced apart teeth;

said drive belt being arranged about each of said first and second driven pulleys and said drive pulley such that the inner side of said drive belt engages with each of said first and said second driven pulleys while the outer side of said drive belt engages with said drive pulley.

16. A vibrational dampening system as defined in claim 15 further characterized in that the net effect of rotating the mass centers of each of said first, second and third counterweights produces a counter balancing force along the line of reciprocation of said reciprocating mass.

17. A vibrational dampening system as defined in claim 16 further characterized in that an adjustable idler pulley is mounted to said support such that the path of said drive belt is diverted away from said drive pulley by said idler pulley after said belt departs from said second driven pulley and before engaging with said first driven pulley; and wherein each of said first, second and third central axes is located in a common plane with one another.

18. A vibrational dampening system as defined in claim 15 further characterized in that the combined mass of each of said first, second and third counterweights is equal to the mass of the reciprocating knife and associated linkage; and wherein the mass of said first counterweight associated with said drive pulley equals one-half of said total mass of said reciprocating knife and its said associated connecting linkage and the mass of each of said second and said third counterweights is equal to one-half of the mass of said first counterweight.

19. A vibrational dampening system as defined in claim 17 further characterized in that each of said first and said second driven pulleys and said drive pulley is formed from an aluminum alloy and wherein each of said first, second and third counterweights is formed from steel.

* * * * *